US005972269A

United States Patent [19]

Barros et al.

[11] Patent Number: 5,972,269

[45] Date of Patent: Oct. 26, 1999

[54] METHOD OF FORMING CAVITIES IN CERAMIC OR METAL INJECTION MOLDED PARTS USING A FUGITIVE CORE

[75] Inventors: Eduardo L. Barros, Miami; Eugene R. Andreotti, Lighthouse Point, both of Fla.

[73] Assignee: Taurus International Manufacturing, Inc., Miami, Fla.

[21] Appl. No.: 08/909,693

[22] Filed: Aug. 12, 1997

Related U.S. Application Data

[60] Provisional application No. 60/050,004, Jun. 17, 1997.

[51] Int. Cl.[6] ..... B22D 3/02; C04B 38/04

[52] U.S. Cl. ..... 264/221; 264/635; 264/645; 264/669; 264/670; 264/328.2; 264/317; 419/5; 419/65

[58] Field of Search ..... 264/221, 635, 264/645, 669, 670, 328.2, 317; 419/5, 65

[56] References Cited

U.S. PATENT DOCUMENTS

| | | | |
|---|---|---|---|
| 4,113,480 | 9/1978 | Rivers . | |
| 4,158,688 | 6/1979 | Pett et al. . | |
| 4,158,689 | 6/1979 | Pett et al. . | |
| 4,591,470 | 5/1986 | Goto et al. | 264/317 |
| 4,721,599 | 1/1988 | Nakamura | 419/23 |
| 5,043,121 | 8/1991 | Wingefeld et al. | 264/344 |
| 5,155,158 | 10/1992 | Kim | 264/125 |
| 5,262,100 | 11/1993 | Moore | 264/221 |
| 5,342,573 | 8/1994 | Amano | 419/8 |
| 5,366,679 | 11/1994 | Streicher | 264/645 |
| 5,492,660 | 2/1996 | Vyletel | 264/221 |
| 5,531,958 | 7/1996 | Krueger | 419/44 |

*Primary Examiner*—James Derrington
*Attorney, Agent, or Firm*—Liniak, Berenato, Longacre & White

[57] ABSTRACT

A method of injection molding ceramic or metal parts having an internal cavity or other complicated shape. A fugitive core is formed of a particulate and a first binder. The core is then suspended in a conventional injection molding cavity. The part is then injection molded by injecting a ceramic or metal powder mixed with a second binder while in a plastic state into the mold cavity and around the suspended core. Once the second different binder hardens or gels, the molded part together with the core are removed from the mold cavity. The molded part and core are then subject to a debinding process to debind the first binder to thereby remove the core. Because two different binders were used for the core and molding, the binder used to form the molded part remains unaffected when removing the core.

2 Claims, 3 Drawing Sheets

METHOD OF FORMING CAVITIES IN CERAMIC OR METAL INJECTION MOLDED PARTS USING A FUGITIVE CORE

This application claims the benefit of U.S. Provisional Application No. 60/050,004 filed Jun. 17, 1997.

BACKGROUND OF THE INVENTION

1. Field of the Invention

This invention pertains to a method of forming cavities in metal injection molded parts that cannot be formed by using a hard mechanically extractable core in the mold and particularly is directed to the use of a fugitive core having a different binder than that used to produce the molded part.

2. Description of the Prior Art

Metal injection molding and ceramic injection molding technologies involve mixing a fine particulate material with a binder. When this mixture is in a plastic condition it is injected into a closed mold where it takes on the configuration of the mold cavity. While in the mold cavity, the binder mixture hardens, sets up or gels to a state where the molded part may be removed from the mold cavity.

After the molded part is removed from the mold cavity the binder is removed without distorting or destroying the molding. The molded part is then sintered into a useable condition.

U.S. Pat. No. 5,043,121 describes a process for removing a polyacetal binder from molded ceramic green bodies with acidic gases and is incorporated herein by reference. U.S. Pat. No. 5,531,958 discloses a process for improving the debinding rate of ceramic and metal injection molded products which use a polymeric binder system and is incorporated herein by reference. U.S. Pat. No. 4,721,599 discloses a method of injection molding metal articles using a water-soluble organic binder and is incorporated herein by reference. U.S. Pat. No. 4,113,480 discloses a method of injection molding powder metal parts using a methylcellulose binder and is incorporated herein by reference. For each of these types of binders, polyacetal, polymeric or water soluble organic, a different process of debinding is used after injection molding the part.

Other variations on these processes are disclosed in U.S. Pat. Nos. 5,155,158; 4,158,689; and 4,158,688; each are incorporated herein by reference.

The drawback in the methods of injection molding according to the prior art is that is difficult to form complicated shapes and particularly difficult to form cavities within the molded part.

An object of the invention is to overcome the drawbacks of the prior art injection molding techniques by providing a simple method of forming complicated shapes and cavities in metal or ceramic injection molded parts.

SUMMARY OF THE INVENTION

The invention is directed to a simple method of injection molding ceramic or metal parts having an internal cavity or other complicated shape. A fugitive core is formed of a particulate and a binder, or a binder alone. The core is then suspended or otherwise disposed in a conventional injection molding cavity. The part is then injection molded by injecting a ceramic or metal powder mixed with a second different binder while in a plastic state into the mold cavity and around the suspended core. Once the second different binder hardens or gels, the molded part together with the core are removed from the mold cavity. The molded part and core are then subjected to a debinding process to debind the binder of the core and remove the core. The two different binders used for the core and molding are selected such that debinding the binder of the core does not affect the structural integrity of the binder, metal or ceramic, used to form the molded part. Such a process affords the ability to simplify the manufacturing process of injection mold parts, having complicated shapes or internal cavities.

DETAILED DESCRIPTION OF THE PREFERRED EMBODIMENT

Figure 1:
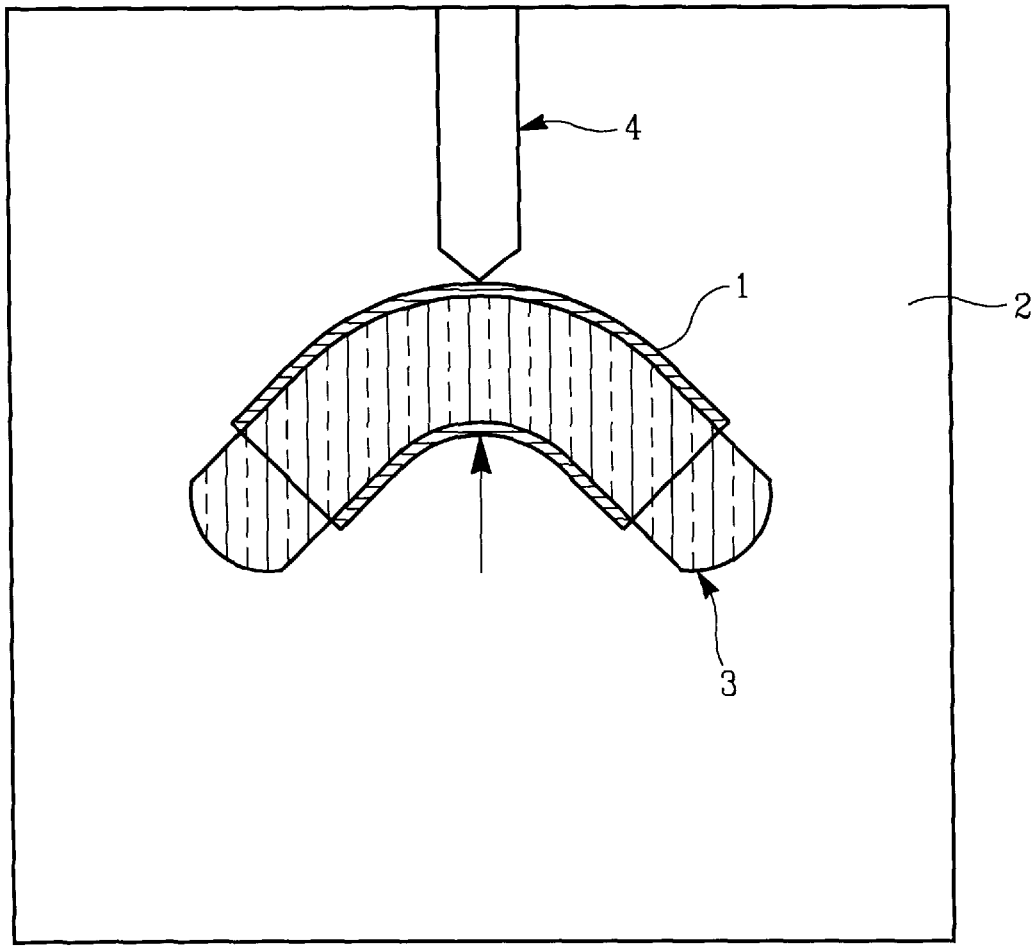
FIG. 1 is a cross sectional view of a part molded in a mold cavity having a suspended core.

FIG. 1 depicts a molded part (1) molded within a mold cavity (2). A fugitive core (3) is suspended within the mold cavity (2) to form a cavity in the molded part (1).

A fugitive core (3) is made of a particulate material such as glass beads and is mixed with a conventional binder, or a binder material alone may be used. The core (3) is placed or suspended within a conventional mold cavity (2).

A composition of metal or ceramic powder is mixed with a conventional binder different from the binder used to form the fugitive core (3). The different binders are selected such that the debinding process of debinding the binder of the fugitive core (3) does not affect the structural stability of the binder, metal or ceramic used to from the molded part (1).

The mixed composition is then injected into the mold cavity (2) through a gate (4) or other conventional means. The mixed composition is forced around the fugitive core (3). The mixed composition is then allowed to harden or gel sufficient to form and allow removal of the molded part (1).

The molded part (1) is then subject to a debinding process to debind the binder used to form the fugitive core (3). Because different binders were used to form the molded part (1) and fugitive core (3), the molded part (1) is not significantly structurally effected by the debinding process of the core (3). The core (3) may therefore be removed by simply debinding the binder used to from the core (3) and allowing the particulate matter to fall out from the molded part.

Depending on the shape of the core (3) different shapes of internal cavities may be formed in the molded part. In the preferred embodiment, and as shown in FIG. 1, a tubular object may be formed by this process. (This unique process yields a metal injected molded product with undercuts that cannot be formed with conventional hard cores.) The internal surface of the molded part is then made extremely smooth.

Figure 2:
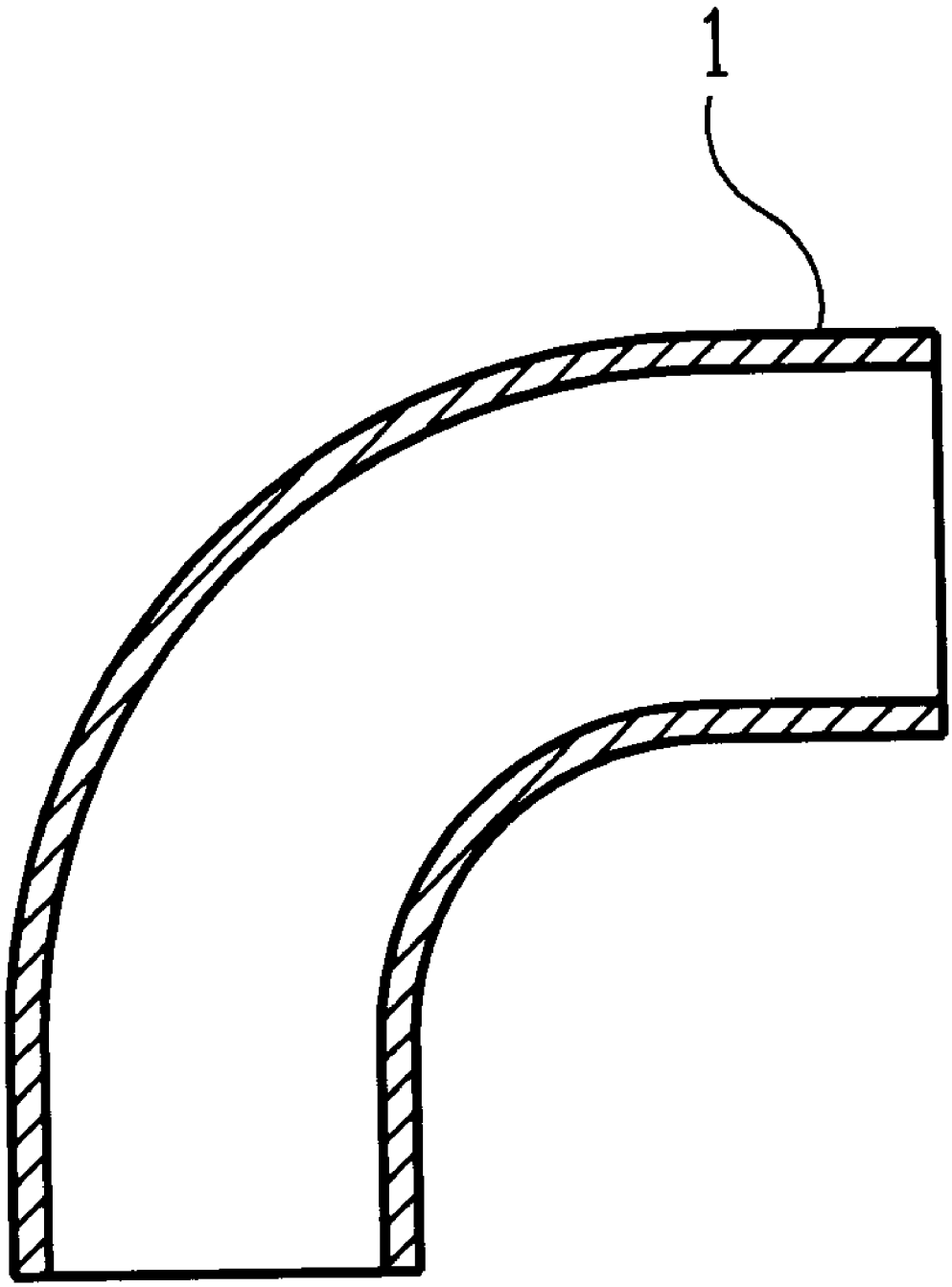
FIG. 2 is a cross sectional view of a finished molded part having an internal cavity.

FIG. 2 depicts an example of a metal part (1) formed by the process according to the invention. A smooth metal tube may be formed having a turn of a smooth radius. FIG. 2 depicts a 90° elbow tubing formed by the method according to the invention.

In the preferred embodiment the fugitive core (3) is made of a mixture of glass beads mixed with a polyacetal binder. This affords a smooth surface and a strong core which can be molded around to form a molded part having an internal cavity or other complicated shape.

The molded part (1) is preferably formed by using a gas-atomized minus 22 micron powder with the composition of 17-4PH, mixed with a methylcellulose binder as similarly described in U.S. Pat. No. 4,113,480.

Debinding the polyacetal binder of the fugitive core (3) does not effect the methylcellulose binder. The process used to debind the polyacetal binder is known in the art and is disclosed in U.S. Pat. No. 5,043,121. Specifically, treatment with acid gases at an elevated temperature may be employed to remove the polyacetal binder. Using this method, the polyacetal binder of the core was quickly and easily removed leaving a soft non-coherent residue of glass powders. The glass powder can simply be removed by low pressure air extraction.

After the fugitive core (3) was removed, the methylcellulose binder of the molded part was removed by conventional thermal debinding at 900–1000° F. in an atmosphere of Nitrogen ($N_2$) and the debound molding was sintered to finish density and properties in a conventional vacuum furnace using commercial techniques.

Figure 3:
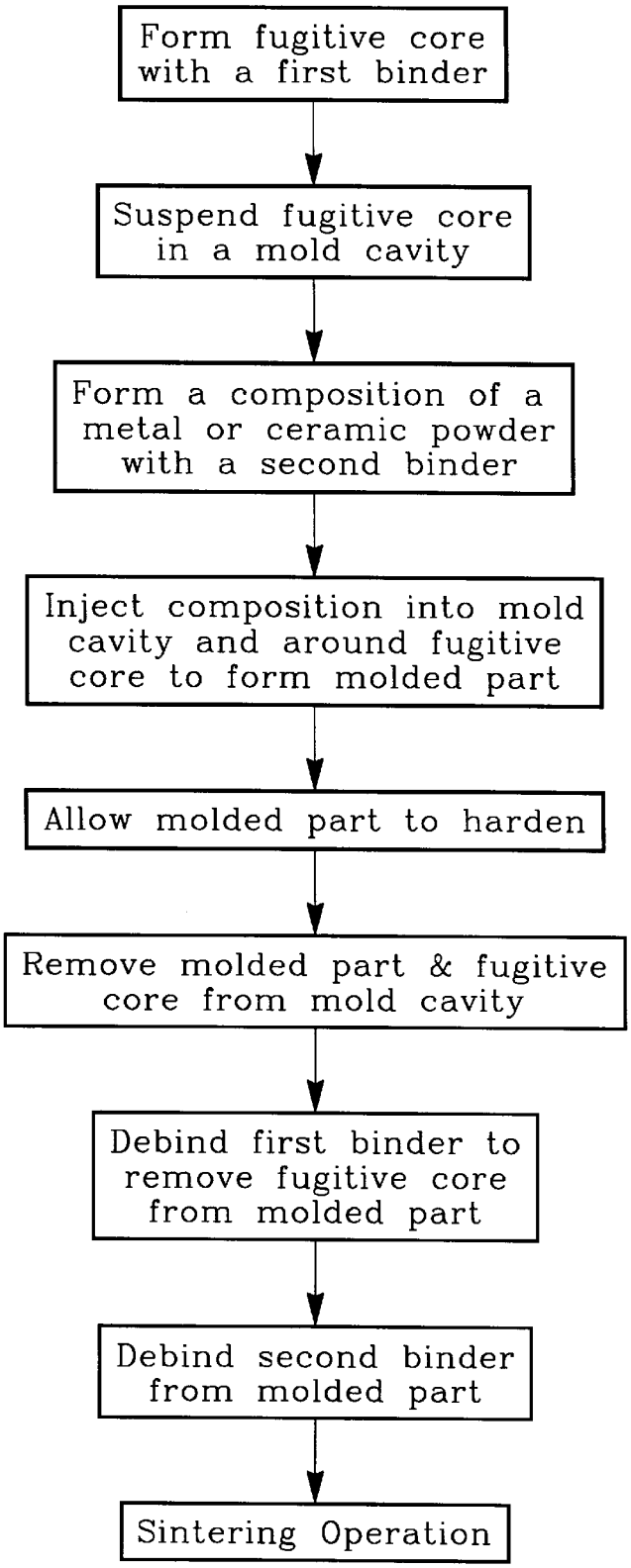
FIG. 3 is a schematic representation of the method of producing an injection molded part according to the present invention.

FIG. 3 depicts a schematic representation of the method of injection molding parts having internal cavities.

While the foregoing invention has been shown and described with reference to a specific preferred embodiment, it will be understood by those possessing skill in the art that various changes and modifications may be made without departing from the spirit and scope of the invention.

For example, any of the three mentioned binders: polyacetal; polymeric; or methylcellulose binders may be used to form either the core or the molded part. It has been shown that each of the conventional debinding processes for these binders does not significantly effect the structurally integrity of any of the other binders. Therefore, any combination of different binders may be used to form the fugitive core and molded part.

We claim:

1. A method of injection molding a part having an internal cavity, comprising the steps of:

forming a core of a particulate mixed with a first binder;

disposing said core within an injection mold cavity:

forming a composition containing one of a metal and ceramic powder dispersed within a second binder;

infecting said composition into said mold cavity and around said core thereby forming a molded part with said cavity;

allowing said second binder to sufficiently harden and removing said molded part from said mold cavity;

debinding said first binder and thereby removing said core from said molded part to expose said internal cavity;

wherein said first and second binders are different compositions such that the debinding of said first binder does not substantially affect the structural stability of said second binder, said particulate of said core is formed of glass beads, and said first binder of said core is formed of a polyacetal binder.

2. A method of injection molding a part having an internal cavity, said method comprising the steps of:

forming a core of glass beads mixed with a polyacetal binder;

suspending said core within an injection mold cavity;

forming a composition containing one of a metal and ceramic powder dispersed within a methylcellulose binder;

injecting said composition while in a plastic state into said mold cavity and around said core thereby forming a molded part with said cavity;

allowing said methylcellulose binder to sufficiently harden and removing said molded part from said mold cavity;

debinding said polyacetal binder and thereby removing said core from said molded part to expose said internal cavity; wherein, said polyacetal and methylcellulose binders are of different compositions such that the debinding of said polyacetal binder does not substantially effect the structural stability of said methylcellulose binder.

* * * * *